United States Patent [19]

Relyea et al.

[11] 4,341,155

[45] Jul. 27, 1982

[54] CUSTOM LABEL PRINTER

[75] Inventors: Kenneth D. Relyea, Grove City; Dale A. Beard, Dayton, both of Ohio

[73] Assignee: Drustar, Inc., Grove City, Ohio

[21] Appl. No.: 193,620

[22] Filed: Oct. 3, 1980

[51] Int. Cl.[3] ..... B41L 27/26; B65H 23/22

[52] U.S. Cl. ..... 101/125; 101/233; 226/43

[58] Field of Search ..... 101/125, 118, 114, 112, 101/45, 232, 233, 247, 48-50; 226/42, 43, 45, 8, 10; 250/548

[56] References Cited

U.S. PATENT DOCUMENTS

| | | | |
|---|---|---|---|
| 2,995,968 | 8/1961 | Tomberg | 226/42 X |
| 3,399,306 | 8/1968 | Guastavino | 250/548 X |
| 3,424,911 | 1/1969 | Cockrell | 250/548 |
| 3,431,425 | 3/1969 | Brown et al. | 250/548 |
| 3,552,308 | 1/1971 | Minehart | 226/42 X |
| 3,637,123 | 1/1972 | Jones, Jr. | 226/42 |
| 3,700,908 | 10/1972 | Devaney, Jr. | 226/45 |
| 3,756,899 | 9/1973 | Von Hofe et al. | 101/233 X |
| 3,829,080 | 8/1974 | Braen et al. | 226/43 |
| 3,858,052 | 12/1974 | Luska | 250/548 |
| 3,886,863 | 6/1975 | Carabott et al. | 101/125 |
| 3,889,111 | 6/1975 | Moss | 226/45 |
| 3,948,170 | 4/1976 | Ericsson | 101/232 X |
| 4,015,523 | 4/1977 | Evans et al. | 101/233 |
| 4,095,887 | 6/1978 | Herten et al. | 250/248 X |
| 4,226,209 | 10/1980 | Kenworthy | 101/125 |
| 4,266,123 | 5/1981 | Friberg | 250/548 X |

FOREIGN PATENT DOCUMENTS

| | | | |
|---|---|---|---|
| 700046 | 12/1964 | Canada | 226/45 |
| 752978 | 2/1967 | Canada | 250/548 |
| 1388579 | 3/1975 | United Kingdom | 250/548 |

*Primary Examiner*—E. H. Eickholt

*Attorney, Agent, or Firm*—Francis T. Kremblas, Jr.; Frank H. Foster

[57] ABSTRACT

This invention relates to a printing apparatus and more particularly relates to a printer which permits rapid preparation of the label legend and quick printing of relatively small numbers of customized labels for use in labelling medicaments in hospitals and pharmacies, industrial products and the like.

3 Claims, 7 Drawing Figures

| RESISTORS | | |
|---|---|---|
| R1-R4 | 220 Ω | |
| R5 | 1500 Ω | 2WATT |
| R6 | 27 Ω | 2WATT |
| R7, R21, R25 | 100K | |
| R8, R17, R20 | 22K | |
| R9, R14, R18, R22 | 6.8K | |
| R24, R26, R31 | 6.8K | |
| R10, R11, R23 | 560K | |
| R12, R15 | 100 Ω | |
| R13 | 500 Ω | TRIMPOT |
| R16, R27-R29 | 2.2K | |
| R30 | 680 Ω | |

| CAPACITORS | | | |
|---|---|---|---|
| C1-C4 | .047uf | 200V | |
| C5 | 200uf | 25V | ALUM |
| C7, C8 | .05 | 20V | NONE CERAM |
| C9 | .001 | DISE | |
| C10 | 1.5uf | 12V | TANT |
| C11, C12 | 10uf | 12V | TANT |
| C6, C13, C14 | .22 | | NONE CERAM |

| IC'S | |
|---|---|
| U1 | 79612 |
| U2 | MOC3011 |
| U3 | LM324 |
| U4 | 4081 |
| U5 | 4528 |
| U6 | 4013 |
| U7 | 40098 (80098) |

| DISCRETE SEMICONDUCTORS | |
|---|---|
| D1 | |
| D2, D3 | |
| D4 | IN4148 |
| Q1-Q3 | 2NG073B |
| Q4 | MPSA05 |
| D5 | |

| MISCELLANEOUS | |
|---|---|
| T1 | F-139P (TRIAD) |
| V1 | V130LA10 (GE) |

FIG. 7

CUSTOM LABEL PRINTER

BACKGROUND OF THE INVENTION

The preparation of labels for one or a few containers of medicines or other objects is easily accomplished by the individual typing of these labels. The labelling of large numbers of containers, such as over the counter medicines, is easily accomplished by conventional printing. However, hospitals, pharmacies and other businesses often have the need for relatively short runs of particular labels. A hospital, for example, may need twenty-five of one label, fifty of another, one hundred of another, ten of yet another and so on.

Conventional apparatus requires a considerable amount of time for the preparation of embossed plates or the setting of type. Although this delay can be avoided by using stencils which can be easily prepared on a conventional typewriter, the conventional label printers which use stencils require the handling of ink to saturate a pad or roller and therefore tend to be quite messy.

The conventional devices also utilize mechanical systems for indexing the labels which limits them to use with only a label of a single size and ordinarily only with a particular type of label.

Accordingly, it is an object of the present invention to provide a machine which uses an ink impregnated pad so that a small quantity of customized labels can be quickly prepared utilizing stencils which can be prepared on a conventional typewriter and yet avoiding the handling of messy inks.

Another object of the present invention is to provide a printing apparatus which will automatically print a selected number of labels at a high speed.

Another object of the present invention is to provide an apparatus which can print labels of varying lengths.

BRIEF DESCRIPTION OF THE INVENTION

The invention is an apparatus for printing information on each of a plurality of interconnected labels, the labels having a region of substantially different light reflection or transmission characteristics which is associated with each label. The apparatus has a label advance means for at times advancing the interconnecting labels along a path which includes a printing station. The advance means at times stops the labels at the printing position in response to the state of a control input signal.

A printing means at the printing station prints the information on the label in response to the state of the print control input signal from a control circuit means. A photo cell radiator and detector means are mounted adjacent the label path for registration with the regions of substantially different light reflection and transmission characteristics which are associated with each label. These detect the presence of a boundary between a label which is adhered to its peelable backing and a space between the labels where only the peelable backing is present along the light path. A control circuit receives its signal from the photo cell detectors and controls the stopping of the advance means and the printing of the message on the label. The control circuit has an automatic light adjustment circuit so that it is insensitive to changes in light transmission or reflection properties of different labels. Stencils, which may conveniently be cut upon a conventional typewriter, are used in conjunction with a porous, elastomeric pad which is impregnated with ink and mounted behind the stencil.

BRIEF DESCRIPTION OF THE DRAWINGS

FIG. 7 is a table showing the circuit element valves.

Figure 1:
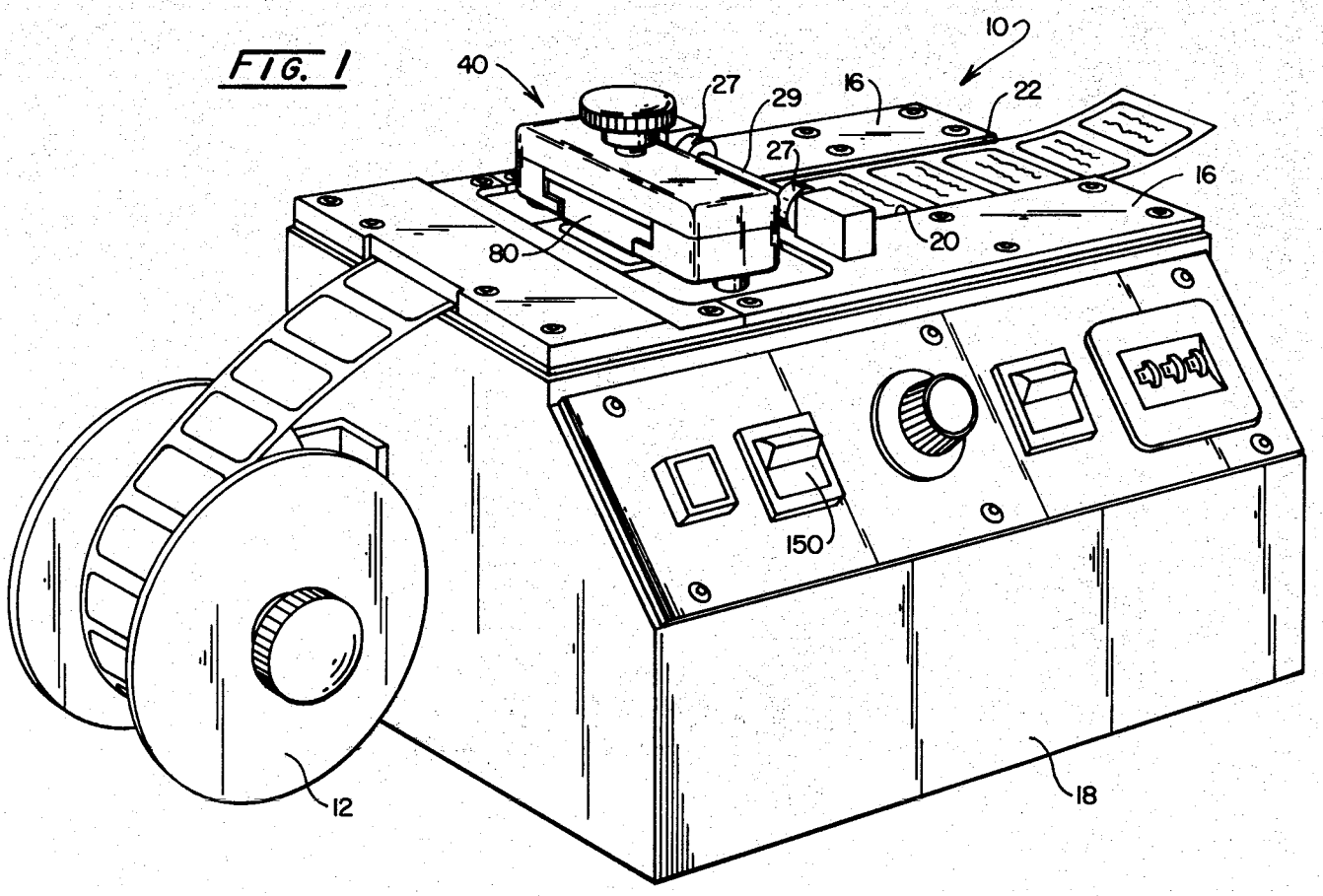
FIG. 1 is a view in perspective of the preferred embodiment of the invention.
Figure 2:
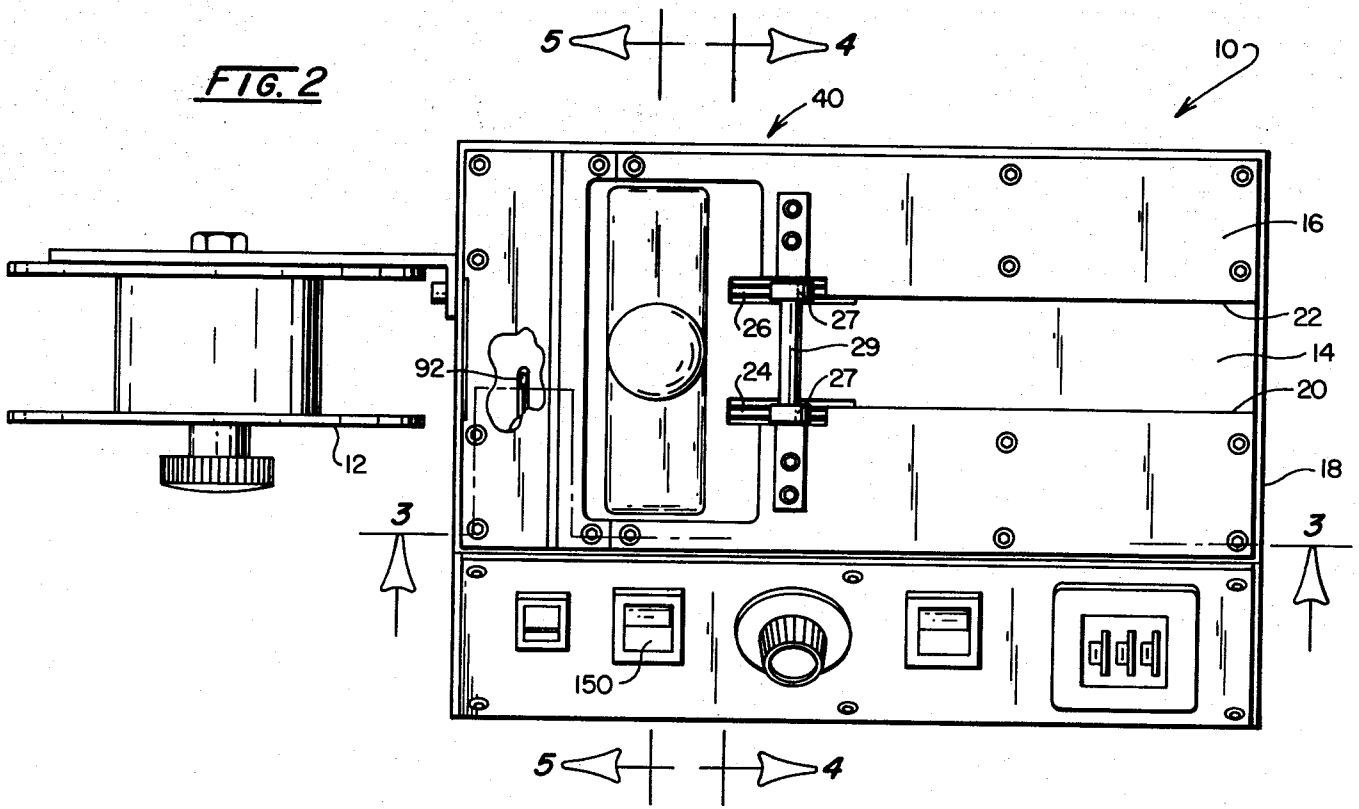
FIG. 2 is a top plan view of the embodiment of FIG. 1.

In describing the preferred embodiments of the invention illustrated in the drawings, specific terminology will be resorted to for the sake of clarity. However, it is not intended to be limited to the specific terms so selected and it is to be understood that each specific term includes all technical equivalents which operate in a similar manner to accomplish a similar purpose. For example, the term connection is not necessarily confined to direct connection but includes effective connection through other elements where such connection is known as being equivalent by those skilled in the art.

DETAILED DESCRIPTION

Figure 5:
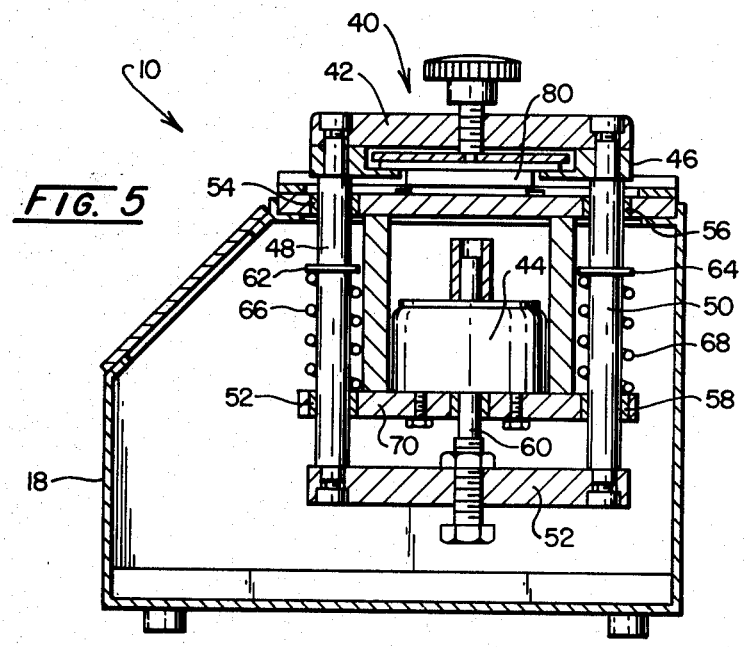
FIG. 5 is a view in vertical section taken substantially along the lines 5—5 of FIG. 2 and particularly illustrating the solenoid and carriage components of the present invention.
Figure 6:
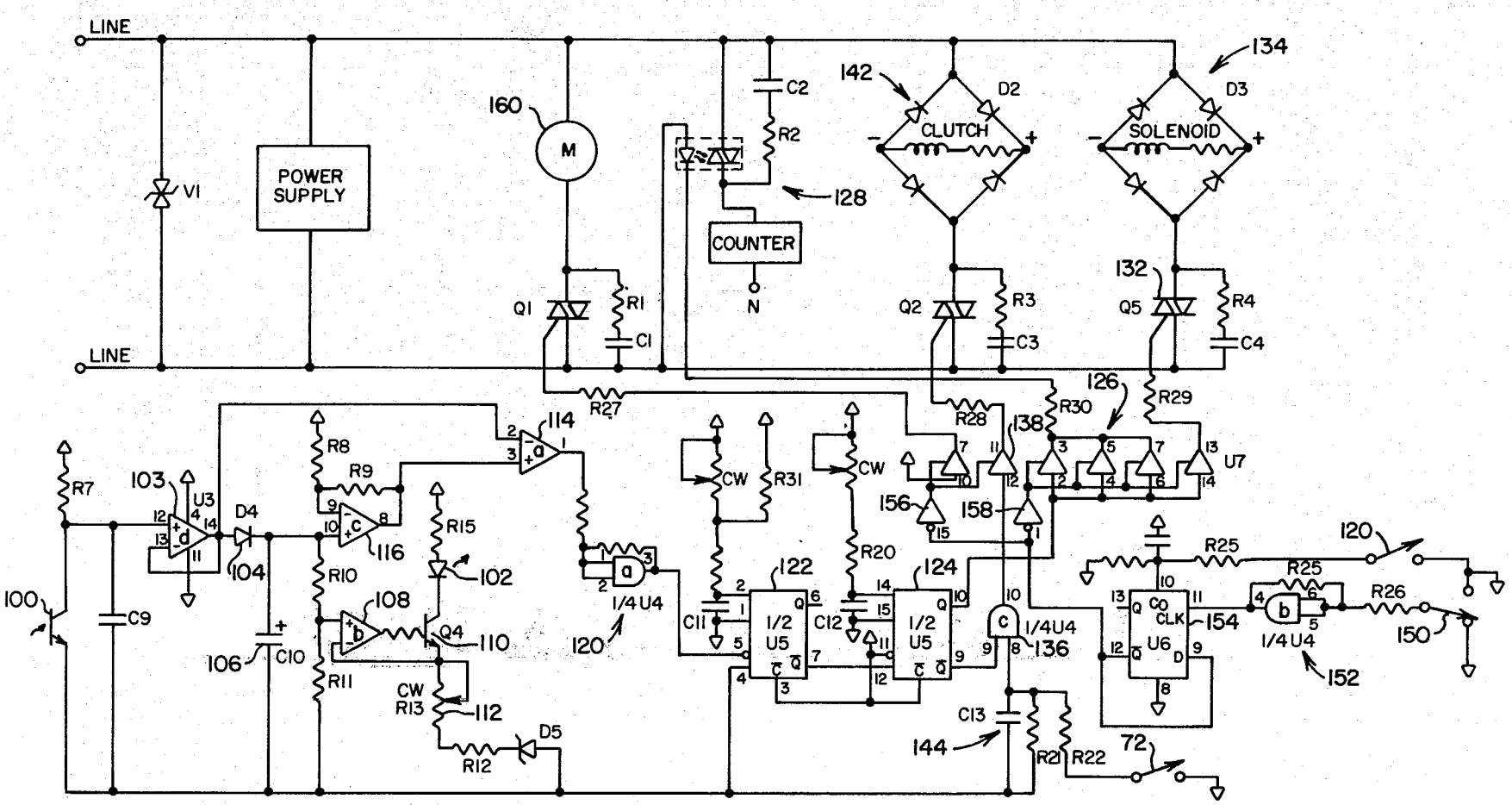
FIG. 6 is a schematic diagram of the control circuit of the present invention.

The apparatus of the present invention for printing information on each of the plurality of interconnected labels is illustrated in FIGS. 1-5 and its control circuit is illustrated in FIG. 6.

Referring to FIGS. 1-5, the apparatus has a supporting cabinet 10 with a supply reel 12 mounted at the rearward end of the cabinet. The supply reel 12 contains a roll of interconnected labels. These are preferably pressure sensitive adhesive labels spaced along a ribbon of peelable backing. Thus, the light transmissivity of the roll at a label is less than it is at the space between the label where the light is transmitted only through the peelable backing.

The labels are fed along a horizontal track 14 formed by a channel along the top of the cabinet 10. The central edges of top panels 16 and 18 overhang the track 14 to form retaining shoulders 20 and 22 at the top edges of the track 14.

A label advance mechanism includes a pair of friction wheels 24 and 26 each having a resilient O ring, such as the O ring 28 on friction wheel 24 about its circumference and each engaging an edge of the ribbon of labels. These friction wheels 24 and 26 are fixed to an axle 30 which is rotatably journalled to the cabinet and is drivingly linked to an electric motor 32 through pulleys 34 and 36 and drive belt 38.

Immediately above the friction wheels 24 and 26 are a pair of idle rollers 25 and 27 which are fixed to a shaft 29 which is in turn rotatably mounted and downwardly resiliently biased to hold the edge of the label ribbon against the friction wheels 24 and 26.

The pulley 36 is equipped with an electromagnetic clutch which provides an advance control means and includes a braking mechanism for preventing coasting. Thus, the clutch at times advances the interconnected labels along the label path formed by the track 14 and at times stops the advance of the labels under the control of the control system.

Thus, the label advance means is controllable both by a controllable drive means consisting of the electric motor which may be turned on or off and an advance control input which is the electric input to the electromagnetic clutch and brake. Both of these are connected to the electronic control circuit. The electric motor is energized continuously during operation of the machine and the advance of the label ribbon is controlled by enerization and deenerization of the electromagnetic clutch and brake.

A motor speed control may be connected to the motor for the manual adjustment of the cycling speed of the apparatus so that labels may be printed at a desired rate.

The labels are advanced by rotation of the friction wheel 24 and 26. When the electromagnetic clutch is deenergized its brake is automatically applied and the drive is disconnected so that the label advance is stopped within a brief period of time.

Immediately upstream from the label advance means is a printing station indicated generally as 40. The printing station has a printing means 42 which moves downwardly when the label advance is halted and prints the information on a label which is positioned at the printing station 40. The printer 42 is actuated and driven downwardly by a solenoid 44 the input to which forms a print control input from the electronic control circuit. The overhanging shoulders along the edges 20 and 22 of the horizontal label track are terminated in the region of the printing station 40 so that the entire width of the label is exposed for printing.

The printing mechanism is shown in more detail in the vertical section of FIG. 5. It comprises a print head 46 which is bolted to a pair of vertical columns 48 and 50 which in turn have a bottom horizontal cross bar 52 bolted to their lower ends. The vertical columns 48 and 50 are slideable in bushings 52, 54, 56 and 58 which are fixed relative to the cabinet 10. Thus, the print head 46 along with the two columns 48 and 50 and the cross bar 52 form a vertically reciprocatable carriage which is attached to the solenoid 44 by means of the solenoid shaft 60. Retainer rings 62 and 64 are resiliently held in annular slots formed in the columns 48 and 50. Compression spring 66 and 68 are mounted between the retainer rings and the solenoid support plate 70 which is fixed with respect to the cabinet 10.

Therefore, when the solenoid is electrically actuated, the entire carriage, including the print head 46, is thrust downwardly and compresses the springs 66 and 68. Deenergization of the solenoid enables the springs to raise the print head away from the label which is positioned at the printing station.

Figure 3:
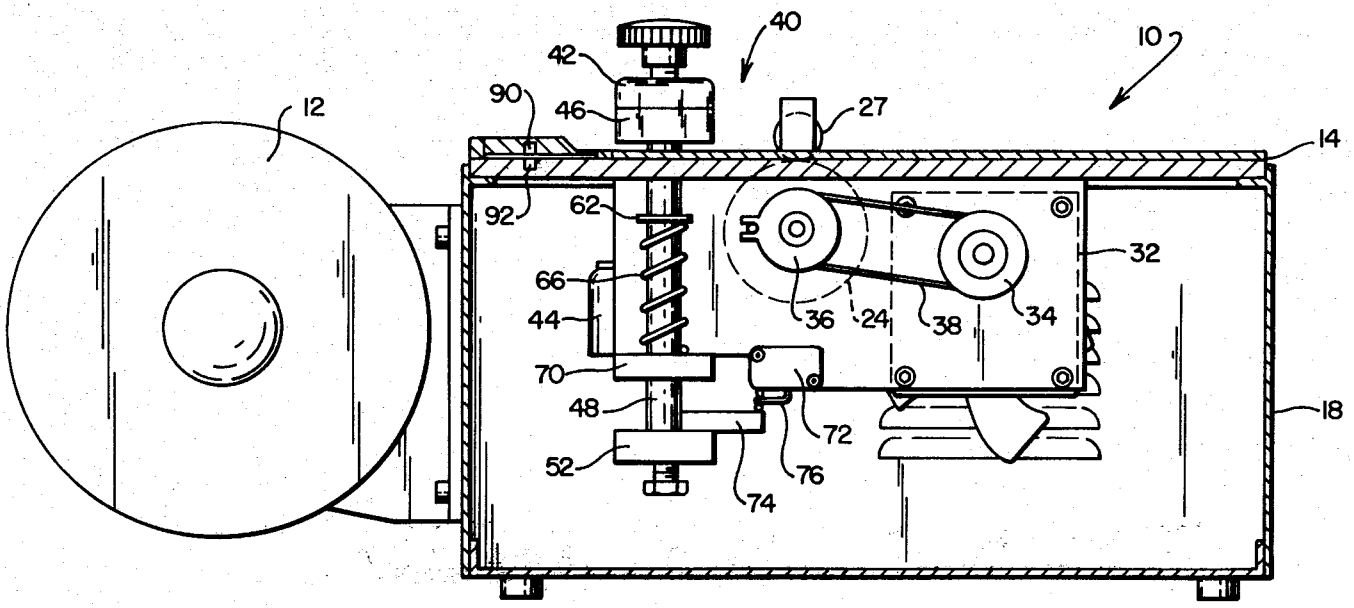
FIG. 3 is a view in side elevation of the embodiment illustrated in FIG. 1.
Figure 4:
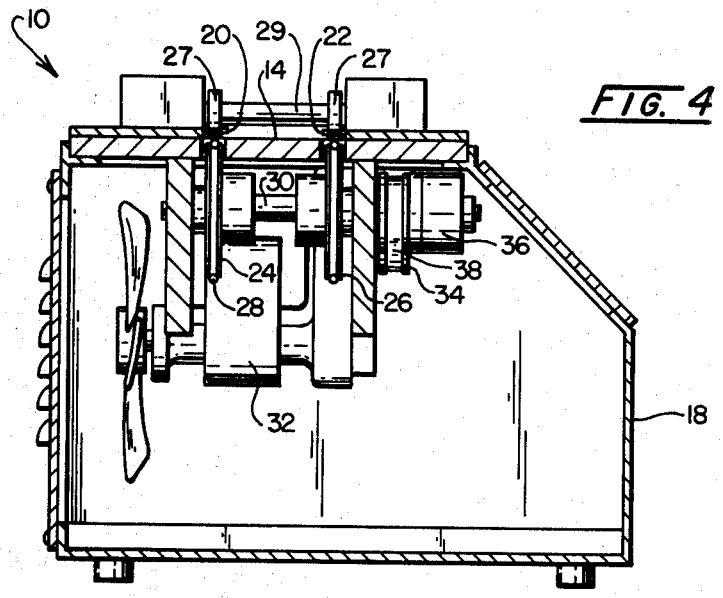
FIG. 4 is an end view in elevation of the embodiment of the invention illustrated in FIG. 1.

Referring now to FIG. 3, a microswitch 72 is mounted to the cabinet 10. An arm 74 is mounted to the bottom crossbar 62 of the print head carriage and engages the microswitch. When the carriage is lowered by the solenoid for a printing operation, the actuating arm 76 of the microswitch 72 is released by the arm 74 to open the microswitch. When the printing operation is complete and the print head carriage has returned upwardly, the microswitch 72 is again closed. The microswitch is connected to the electronic control circuit to assure that the labels will not be advanced until the print head 46 is raised above the label at the printing station. The microswitch 72 effectively disables the label advancing means during operation of the printing means and when again closed initiates the resumption of the advancing means after the completion of the print operation.

The printing structure which is preferred is a porous pad 80 which is impregnated with ink and mounted through intermediate, supporting substrates to the print head 46 which forms a support platform for the porous pad. Preferably the porous pad is a porous elastermeric pad such as a pad sold under the trademark Porlon. Such pads are sold for use in hand stamps in which the printing is accomplished by embossing the Porlon pad into the shape of the desired indicia. I have found, however, that, contrary to the manufacturer's opinions and specifications, the flat Porlon pad will work well with a stencil mounted beneath it having performations in the form of the indicia to be printed on the label. This permits the desired indicia to be cut through the fluid impervious stencil on a conventional typewriter and then mounted beneath the pad for each run of labels.

Therefore, when the print carriage is actuated by the solenoid and driven downwardly, the stencil sheet is pushed against the label and the pad is squeezed against the label through the openings in the stencil to form the printed label.

For detecting the positioning of the labels spaced along the ribbon, a photo radiator such as a photo diode and a photo detector such as a photo transistor are mounted adjacent the label path for registration with the regions of the ribbon having different transmissivity or reflectivity. In the preferred embodiment they operate in the infra red region of the light spectrum. One is mounted above the label path at 90 and the other is beneath at 92. In this preferred mode, changes in light received by the photo cell detector, as a result of labels passing between the photo radiator and photo detector, are sent to the electronic control circuit means to indicate the presence of a label edge.

It should also be noted that the photo detection system may also be operated in the reflective mode with both the photo radiator and the photo detector mounted adjacent the label but on the same side, such as beneath it. In the preferred embodiment, the region between the labels is less opaque than the region of the peelable backing on which a label is adhered.

Some labels are provided with small perforations or holes through the backing layer between the labels. The photo radiator and photo detector means are advantageously mounted at this position so that the holes may be conveniently detected and used by the electronic circuit control means for stopping the advance of the ribbon of labels and for actuation of the printing means.

The control circuit means is connected to the photo radiator and detector means, the advance control input which is the input to actuate the electromagnetic clutch and to the print controller input which is the solenoid 44.

The control circuit operates generally to stop the advance of the labels and then initiate the operation of the printer in response to registration of a label edge with the light path between the photo means.

Referring to FIG. 6, the photo detector is a photo transistor 100 which receives light from the photo radiator 102. The output of the photo transistor 100 is connected through a buffer amplifier circuit 103 to a peak detector circuit consisting of diode 104 and capacitance 106. The operation of the peak detector circuit is known in the art because such circuits are used in the demodulation of amplitude modulated signals. The capacitance 106 is charged by the peaks of the output of the buffer amplifier 103. It discharges only slowly due to the long time constant of resistors R10 and R11 combined with the capacitance of capacitor 106. The discharge time constant is large compared to the period of the peaks.

The peak signals from the buffer amplifier 103 represent minimums of light received by the photo transistor 100. This inversion of the light signal occurs because the photo transistor 100 becomes more conductive for increased light and therefore lowers the voltage to the input of the buffer amplifier 103 at light maximums. Therefore, the voltage across the resistors R10 and R11 represents and is proportional to the average minimum light intensity reveived by the photo transistor 100. The minimum light intensity occurs when a label is between the photo radiator and the photo transistor 100.

The photo radiator 102 is driven by an amplifier 108 driving a transistor 110 connected as a voltage controlled current source. Therefore, the current through the photo diode 102 and therefore its emitted light is controlled by the voltage across the capacitance 106.

The circuitry from the photo transistor 100 to the photo diode 102 forms the forward loop and the light path from the photo diode 102 to the photo transistor 100 forms a negative feedback loop which together form a negative feedback control circuit. Any change in the light level received by the photo transistor 100 results in an adjustment of the light emitted from the photo diode 102 to bring the light received by the photo transistor 100 nearly back to its original value in accordance with traditional feedback control principles.

The initial reference level of light is controlled by a potentiometer 112 which is manually adjusted to a selected initial level.

The output of the buffer amplifier 102 is also connected to the inverting input of a comparator 114. Additionally, the output of the peak detector is applied through an analog multiplier circuit 116 to the non-inverting input of the comparator 114. The amplifier 116 effectively multiplies the minimum light signal from the peak detector by a selected constant. The selected constant must be such that the output voltage level from the multiplier cicuit 116 is intermediate the voltage applied to the noninverting input to the multiplier circuit 116 which represents the minimum light level and the normally expected minimum voltage level at the inverting input of the comparator 114 which represents the maximum light level (at the absence of a label between the photodiode and the photo-transistor).

The multiplication provides an intermediate reference level at the non-inverting input of the comparator 114 to which the input applied to the inverting input is compared in order to determine whether a region of increased transmissivity representing the space between the labels is positioned between the photo radiator and the photo detector 100. Consequently, when a label is positioned between the photo radiator and the photo detector, the voltage applied to the inverting input of the comparator 114 will be greater than the voltage applied to the non-inverting input of the comparator 14 and its output will represent a "zero" state. This state means that a label is present.

When the label edge passes between the photo radiator and photo detector, the voltage at the output of the buffer amplifier 103, and therefore the voltage applied to the inverting input of the comparator 114 will be reduced because of the increased light received by the photo transistor 100. The circuit is designed so that for conventional reels of labels this drop will be below the reference voltage which is applied to the non-inverting input of the comparator 114 and therefore the output of the comparator 114 will switch to its "one" state.

The output from the comparator 114 is applied to a pulse shaping circuit 12 and then to a one-shot 122 which is a part of a dual one-shot integrated circuit. The one-shot 122 is fired upon detection of the label edge. It's timing circuitry, which may be fixed or adjustable, is designed so that the one-shot will return to its original state after a selected time delay period. The time period of the delay is selected to be the desired time from the time the edge is detected until the electromagnetic clutch is actuated to stop the advance of the labels and the solenoid is actuated to print the label.

The $\bar{Q}$ output of the one-shot 122 is connected to another one-shot 124. The time delay of the one-shot 124 determines the time that the solenoid will be actuated for printing the label. Thus, when the one-shot 122 switches back to its stable state, the transistion will fire the one-shot 124. The Q output of the one-shot 124 is connected through three parallel, three state buffers, 126 to a counter circuit 128 for decrementing the counter. The counter is a manually set counter by which the operator selects the number of labels which is desired. Thus, each actuation of the printer decrements the counter 128.

The Q output of the one-shot 124 is also connected through a three state buffer 130 to a triac 132 which controls the solenoid 134. The solenoid is positioned in a bridge rectifier because it is DC operated.

The $\bar{Q}$ output of the one-shot 124 is connected to the input of an AND gate 136, the output of which is connected through a three state buffer 138 to a triac 140 which controls the electromagnetic clutch 142. Like the solenoid, the electromagnetic clutch is DC operated and therefore is positioned in a bridge rectifier. The other input to the AND gate 136 is connected through a debounce filter and gate protection circuit 144 to the microswitch 72, which is described above. Upon initial actuation of the one-shot 124, the microswitch 72 is in its closed position. Therefore, actuation of the one-shot 124 deenergizes the clutch 142, energizes the solenoid 134 and decrements the counter 128. The resulting movement of the printhead opens the microswitch 72.

At the end of the time delay of the one-shot 124, it will return to its stable state. Upon returning, the solenoid is thereby deenergized. Deenergization of the solenoid 134 permits return of the print carriage and print head. When it has returned sufficiently to again close the microswitch 72 the output of the AND gate 136 can then switch to reenergize the clutch and again begin the advance of the label ribbon along the track 14.

A start/stop manual pushbutton switch 150 is provided on the control panel of the cabinet 10. It is connected through a pulse shaping and debounce circuit 152 to the clock input of a flip-flop 154. Each depression of the start/stop switch 150 will toggle the flip-flop to its other state. The $\bar{Q}$ output of the flip-flop 154 is connected through inverters 156 and 158 to the control input of all the three state buffers. Thus, when the flip-flop 154 is in its reset state, the three-state buffers prevent operation of the electric motor 160, the counter 128, the electromagnetic clutch 142 and the solenoid 134.

However, when the flip-flop 154 is toggled to its set state, the motor 160 is energized and the clutch 142, the solenoid 134 and the counter 128 are under the control of the one-shot 124 as described above.

Additionally, the counter is provided with a switch 170 which closes when it has been decremented to zero. This switch 170 is connected to the clear input of the flip-flop 154 so that it will be reset to stop all operation of the device when the counter has decremented to zero.

It is to be understood that while the detailed drawings and specific examples given describe preferred embodiments of the invention, they are for the purpose of illustration only, that the apparatus of the invention is not limited to the precise details and conditions disclosed, that various changes may be made therein without departing from the spirit of the invention which is defined by the following claims.

We claim:

1. An improved apparatus for printing information on each of a plurality of interconnected labels, said labels having a region of substantially different light reflection or transmission characteristics associated with each label, said apparatus of the type having: a label advance means including a controllable drive means having an advance control input for at times advancing said interconnected labels along a label path including a printing station and at times stopping said advance with a label positioned at said printing station in response to the state of the control input; a printing means at said printing station and having a print control input for printing said information at a label positioned at said printing station in response to the state of the print control input; a photo radiator and detector means mounted adjacent said label path for registration with said regions; and control circuit means connected to said photo radiator and detector means, said advance control input and said print control input for stopping the advance of said labels and initiating the operation of said printing means in response to registration of one of said regions with the light path of said photo means, wherein the improvement comprises:

a negative feedback control circuit connected to said photo radiator and detector means for maintaining a constant light intensity received by said photo detector when said labels are interposed in the light path from said photo radiator to said photo detector, said feedback control circuit comprising:

(a) a peak detector connected to the output of said photo detector for providing a signal level proportional to the average minimum light received by said photo detector;

(b) an amplifier having its input connected to the output of said peak detector and its output connected to said photo radiator; and (c) a reference level control for adjusting the radiation from said photo cell radiator to a selected level.

2. An apparatus in accordance with claim 1 wherein said control circuits means further comprises:

(a) a comparator circuit having one input connected to the output of said photo detector;

(b) an analog multiplier circuit having its input connected to the output of said peak detector and its output connected to the other input of said comparator for multiplying said minimum light signal by a selected constant;

wherein the output of said comparator changes states in accordance with the presence and absence of labels in the light path between said photo radiator and photo detector.

3. An apparatus in accordance with claim 2 wherein said peak detector comprises a series connected diode and capacitance connected across the output of said photo detector and having its output at the nodes across said capacitance and wherein said amplifier comprises a voltage adjustable constant current source driving said photo radiator.

* * * * *